United States Patent [19]

Wundrock et al.

[11] Patent Number: 4,852,201

[45] Date of Patent: Aug. 1, 1989

[54] TOILET BOWL CLEANER

[75] Inventors: John A. Wundrock, West Bend; Mary L. Conrardy, Wauwatosa, both of Wis.

[73] Assignee: Badger Pharmacal, Inc., Jackson, Wis.

[21] Appl. No.: 197,684

[22] Filed: May 23, 1988

[51] Int. Cl.[4] ..... A46B 17/02

[52] U.S. Cl. ..... 15/145; 15/147 R; 15/228; 15/244.1

[58] Field of Search ..... 15/147 R, 145, 227, 15/244.1, 228, 244.2, 244.3, 146

[56] References Cited

U.S. PATENT DOCUMENTS

| | | | |
|---|---|---|---|
| 2,715,237 | 8/1955 | Trindl | 15/146 X |
| 2,816,311 | 12/1957 | Beck et al. | 15/210 |
| 2,877,483 | 3/1959 | Alvistur | 15/210 |
| 2,998,614 | 9/1961 | Winch | 15/210 |
| 3,225,375 | 12/1965 | Atkinson et al. | 15/147 X |
| 3,383,158 | 5/1968 | Leland | 15/210 X |
| 3,413,673 | 12/1968 | Gewirz | 15/105 |
| 3,720,976 | 3/1973 | Bailey | 15/227 X |
| 4,031,673 | 6/1977 | Hagelberg | 15/210 R X |
| 4,194,852 | 3/1980 | Cupp et al. | 15/145 X |
| 4,392,269 | 7/1983 | Nishiyama et al. | 15/145 |
| 4,523,347 | 6/1985 | Tames | 15/104.94 |
| 4,619,710 | 10/1986 | Kuenn et al. | 134/22.17 |

*Primary Examiner*—Chris K. Moore

*Attorney, Agent, or Firm*—Andrus, Sceales, Starke & Sawall

[57] ABSTRACT

A toilet bowl cleaner includes an effervescing, foaming cleaning composition contained within a biodegradable packet or pad and a holder for the packet or pad. The holder includes an elongate rigid handle member having a grip end and a head end, a tongue member pivotally mounted on the head end between a first attached position for attaching the disposable toilet bowl cleaning pad to the handle member and a second detached position for releasing the pad from the handle member, and a lock mechanism for releasably locking the tongue member to the head of the handle member. The disposable toilet bowl cleaning pad contains an effervescing compound for cleaning a toilet bowl which includes a surfactant, an alkali carbonate and an acid. Other ingredients may be added to the surfactant-alkali-acid composition to provide desired properties such as halogen containing compounds for providing germicidal properties and fillers as a carrier for the liquid surfactant.

6 Claims, 2 Drawing Sheets

FIG. 1
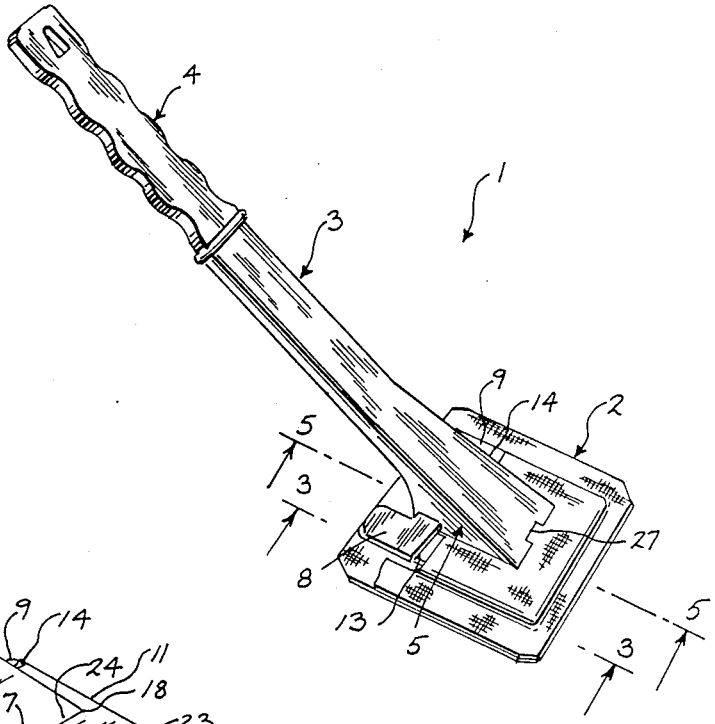
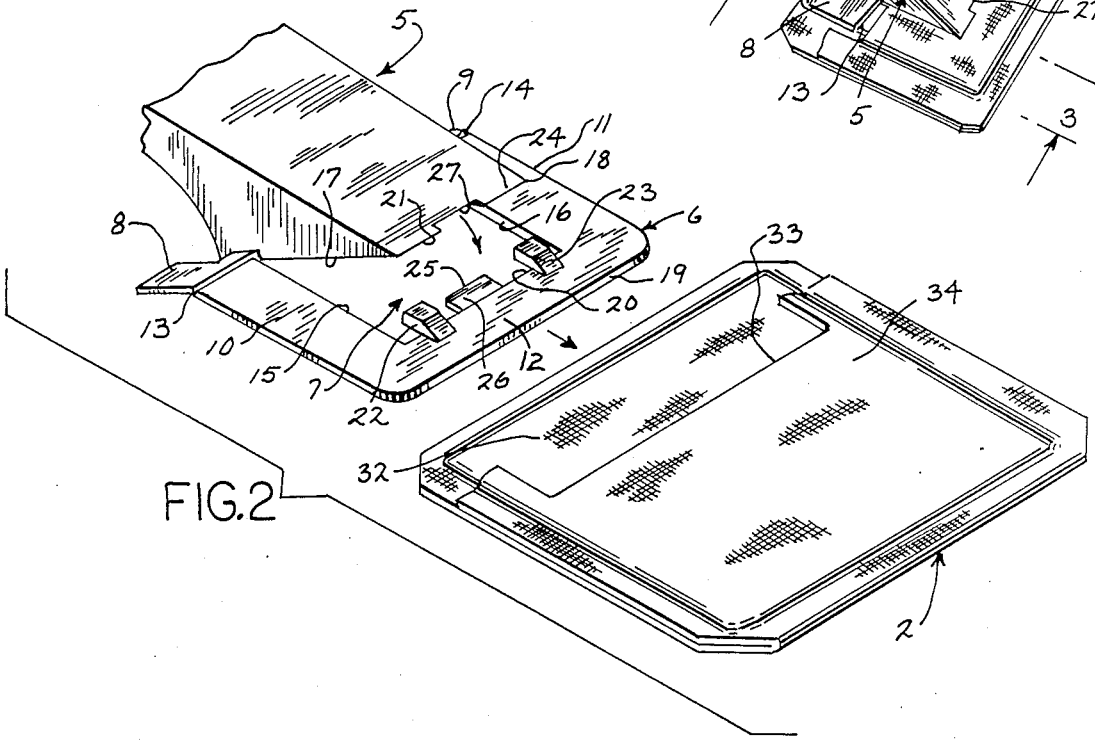
FIG.2
FIG. 3
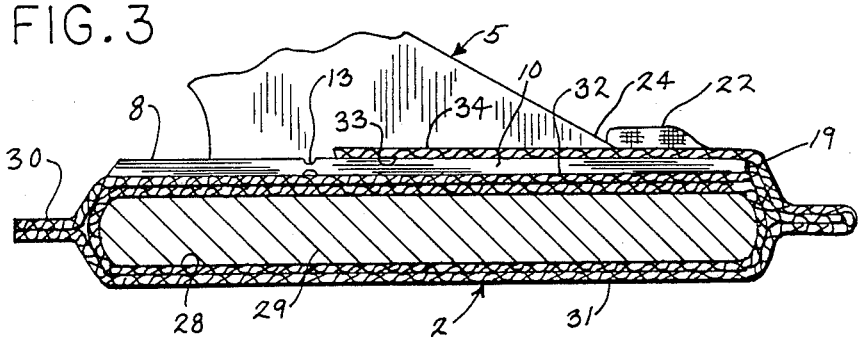

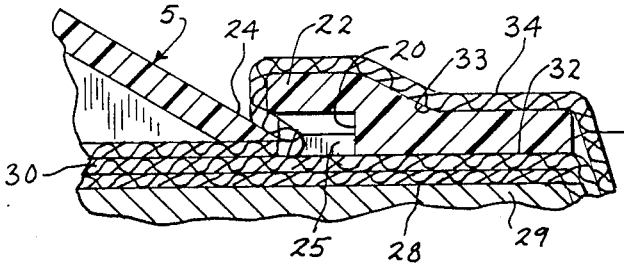
FIG. 4
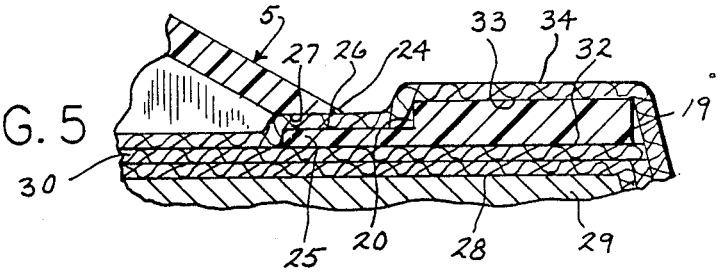
FIG. 5
FIG. 6
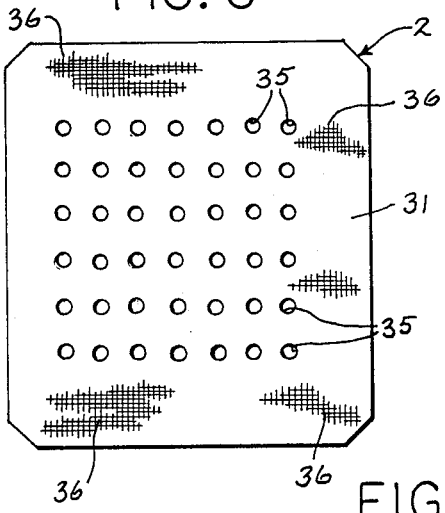
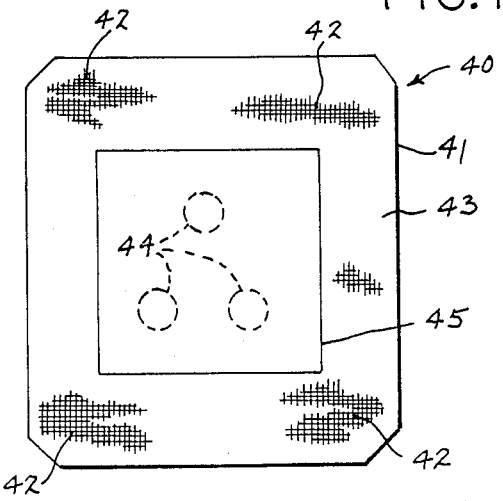
FIG. 8
FIG. 7
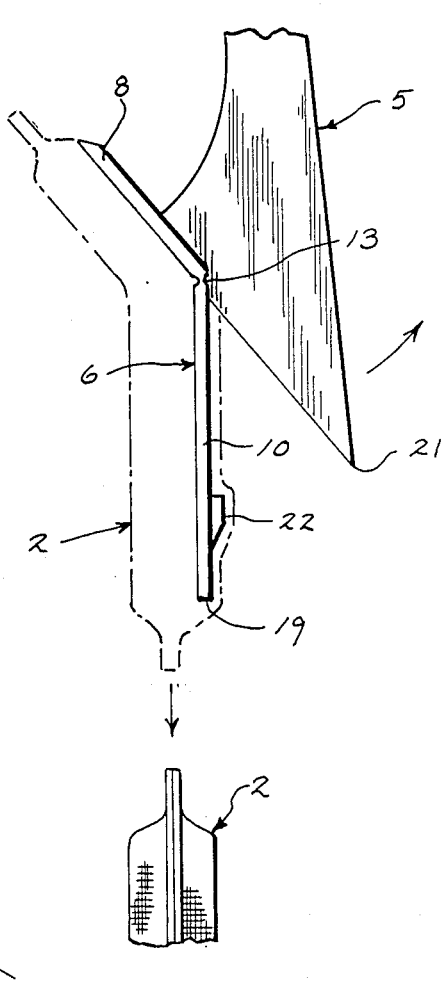

TOILET BOWL CLEANER

BACKGROUND OF THE INVENTION

The present invention relates to cleaning compositions, and more particularly to a holder for a disposable cleaning pad containing a composition suitable for cleaning toilet bowls and the like.

Cleaning a toilet bowl is typically one of the most undesirable jobs for most persons. Nevertheless, toilet bowls must be kept clean in order to prevent sanitary problems, the potential for irritable smells, and the possibility of harmful bacteria buildup.

As a result, various types of bowl cleaning products are known. Such products typically fall within two categories, namely, cleaning by hand with a bowl cleaner or with automatic "in tank" or "in bowl" cleaners. Hand cleaning typically takes the form of a toilet cleaning brush or sponge. Such devices, however, are displeasing due to the excessive dripping therefrom, and because storage between uses is unsanitary. Also, there is no premeasured dosage with current bowl cleaning products. Most users just estimate the amount to use and potentially could use too little thus not achieving a disinfectant level, or too much thus increasing the cost per application. Additionally, bowl cleaning products are very toxic and present a potential safety hazard.

Automatic "in tank" or "in bowl" cleaners, which dispense a dosage upon flushing of the toilet, generally are not as effective as manual scrubbing. Therefore most consumers typically supplement such automatic cleaners with hand scrubbing and cleaning. Besides not thoroughly cleaning, "in tank" or "in bowl" cleaners have other disadvantages. For example, "clear water" type of cleaners give no indication when they are used up and need changing, and having to plunge one's arm into a toilet bowl and/or tank to retrieve spent containers is also unpleasant and undesirable. The "blue water" products are only cosmetic, and at best add a small amount of surfactant to the water.

Numerous types of cleaning compositions as well as holders for disposable cleaning pads are known in the art. Exemplary of such compositions and apparatus are those found in the following United States Patents:

| U.S. Pat. No. | Issue Date | Inventor |
|---|---|---|
| 4,619,710 | 1986 | Kuenn et al |
| 4,523,347 | 1985 | Tames |
| 4,031,673 | 1977 | Hagelberg |
| 3,413,673 | 1968 | Gewirz |
| 3,383,158 | 1968 | LeLand |
| 2,998,614 | 1961 | Winch |
| 2,877,483 | 1959 | Alvistur |
| 2,816,311 | 1957 | Beck et al |

None of the above patents, however, are directed specifically to a composition for cleaning and sanitizing toilet bowls, and although several of the above patents illustrate holders for disposable toilet bowl cleaning pads, there remains a need for an improved holder which permits easy attachment and detachment of a cleaning pad without having to touch the pad.

SUMMARY OF THE INVENTION

A toilet bowl cleaner includes an effervescing, foaming cleaning composition contained within a biodegradable packet or pad and a holder for the packet or pad.

In one aspect of the invention, the holder for the disposable toilet bowl cleaning pad comprises an elongate rigid handle member having a grip portion at one end and a head portion at its opposite end, a tongue member pivotally mounted on the head portion between a first attached position for attaching the disposable toilet bowl cleaning pad to the handle member and a second detached position for releasing the pad from the handle member, and lock means for releasably locking the tongue member to the head portion of the handle member. The head portion includes a leading edge and the tongue member includes a trailing edge spaced forwardly of the head portion leading edge, and the lock means is preferably a snap lock located along the leading and trailing edges of the head and tongue respectively. The snap lock includes a pair of spaced apart resilient fingers projecting rearwardly from the tongue's trailing edge, and the head portion includes an edge margin portion adjacent its leading edge which defines an abutment surface for engagement with the resilient fingers.

The holder further includes fastening means for fastening the toilet bowl cleaning pad to the tongue member when the tongue member is in its attached position. This fastening means comprises a tab member projecting rearwardly from the tongue's trailing edge that defines a clamping surface engageable with the leading edge of the head portion when the tongue member is in its attached position. Preferably, the fastening means further includes a tab receiving recess formed in the leading edge of the head and aligned with the tab whereby at least a portion of the toilet bowl cleaning pad is trapped between the clamping surface of the tab and the recess when the tongue member is in its attached position. The toilet bowl cleaning pad includes a flap forming a tongue receiving pocket for slidably receiving the tongue member when in its detached position, and the toilet bowl cleaning pad portion comprises said flap.

In another aspect of the invention, the toilet bowl cleaning pad includes a composition for cleaning a toilet bowl in either tablet or powder form comprising a mixture of an alkali carbonate, an acid, and one or more surfactants. The alkali carbonate constituent is present in the range of from about 5 to about 40% by weight and preferably between 20 and 40% by weight in the present composition. Suitable alkali carbonates includes sodium bicarbonate, sodium carbonate, calcined sodium carbonate, sodium sequecarbonate, potassium bicarbonate and potassium carbonate. One or more of the above alkali carbonates may be used in the present composition with sodium bicarbonate and sodium carbonate preferred.

The acid constituent is present in the range of from about 5 to about 80% by weight, and preferably between 25 to 75% by weight in the present composition. Suitable acids include those having the formula:

$$HOOC—(CH_2)_n—COOH$$

Where n is 2, 3 or 4. Preferably, the acid is selected from citric acid, sodium bisulfate, oxalic acid, malonic acid, succinic acid, glutaric acid, adipic acid, suberic acid, maleic acid, fumaric acid, sodium citrate, sodium sulfite, potassium citrate, and mixtures thereof. One or more of the above acids may be used in the present composition with citric acid and sodium bisulfate preferred.

The surfactant constituent is present in the range of from about 0.5 to about 20% by weight, and preferably between 0.5 to 8% by weight in the present composition. Suitable surfactants include anionic, nonionic and amphoteric agents such as nonoxynol-9, linear alkyl naphthalene sulfonate, ethoxylated alcohol, alkyl ether sulfates, linear alkyl naphthalene, alcohol ethoxysulfates, alkyl benzene sulfonate, alpha olefin sulfonate, linear alcohol ether sulfates, alkyl sulfates, taurates, sarcosinates, isethionates, cyclorimides, linear alkylbenzene sulfonates, and mixtures thereof. One or more of the above surfactants may be used in the present composition with an ethoxylated alcohol and a linear alkyl naphthalene sulfonate preferred.

In one particularly preferred composition, the alkali carbonate comprises about 22% by weight sodium carbonate, the acid comprises about 75% by weight sodium bisulfate, and the surfactant comprises about 3% by weight ethoxylated alcohol. In another particularly desirable composition, the alkali carbonate comprises about 32% by weight sodium bicarbonate, the acid comprises about 32% by weight citric acid, the surfactant comprises about 3% by weight linear alkyl napthalene sulfonate, and includes about 32% by weight sodium percarbonate as a leaching agent.

Various other constituents in addition to the alkali carbonate, acid and surfactant may be blended into the composition to provide numerous desirable properties. For example, about 0.1 to about 1% by weight of a bactericidal agent such as a quaternary ammonium compound or a halogen containing compound may be utilized. Typical halogen containing bactericidal agents include sodium dichloroisocyanurate dihydrate, alkali metal or alkaline earth metal hypochlorites, hypochlorite addition products, chloramines, clorimines, chloramides, chlorimides, heterocyclic N-Bromo and N-Chloro cyanurates, halogenated hydantoins, halogenated melamines, and inorganic hypohalite releasing agents. Additionally, the composition may include about 1–20% by weight of a filler as a carrier for the liquid surfactant. Suitable fillers include sodium chloride, sodium sulfate, calcium carbonate, diatomaceous earth, and mixtures thereof. Additionally, about 5 to about 40% by weight of a bleaching agent may also be incorporated as a component of the present composition depending upon the particular bactericidal agent utilized. Suitable bleaching agents include sodium percarbonate, sodium perborate, sodium persulfate, potassium persulfate, and mixtures thereof. It should be noted that bleaching agents also contribute to the effervescence which occurs when the acid and alkali carbonate come into contact with water in the toilet bowl to release oxygen and carbon dioxide gas.

The present invention thus provides a holder for disposable toilet bowl cleaning pad, and a composition contained within the pad for cleaning and sanitizing a toilet bowl.

BRIEF DESCRIPTION OF THE DRAWINGS

The drawings illustrate the best mode presently contemplated of carrying out the invention.

In the drawings:

FIG. 1 is a perspective view of a disposable toilet bowl cleaning pad and holder for a toilet bowl cleaner constructed in accordance with the present invention;

FIG. 2 is an enlarged fragmentary exploded perspective view illustrating the manner of assembling the cleaning pad to the head portion of the holder;

FIG. 3 is a cross sectional view taken along the plane of the line 3—3 in FIG. 1 illustrating the pad assembled to the head portion of the holder;

FIG. 4 is a fragmentary cross sectional enlarged view illustrating a snap-lock mechanism for attaching the tongue portion of the holder to the head portion of the holder;

FIG. 5 is a fragmentary cross sectional enlarged view similar to FIG. 4 taken along the plane of the line 5—5 in FIG. 1 illustrating a fastener for fastening the pad to the head portion of the holder;

FIG. 6 is a plan view of the cleaning surface of the cleaning pad;

FIG. 7 is an exploded fragmentary side view illustrating the manner of removing the cleaning pad from the tongue portion of the holder; and FIG. 8 is a plan view similar to FIG. 6 illustrating a second embodiment of the cleaning pad.

DESCRIPTION OF THE PREFERRED EMBODIMENT

Referring now to the drawings, FIG. 1 illustrates a holder 1 for a disposable toilet bowl cleaning pad or packet 2. Holder 1 includes an elongate rigid handle member 3 having a grip portion 4 at one end and a head portion 5 at its opposite end, a tongue member 6 pivotally mounted on head portion 5, and a locking mechanism 7 for releasably locking tongue member 6 to head portion 5 of handle 3.

Handle 3 is formed of a one piece injection molded plastics material, and is formed integrally in a U-shaped cross section. Grip portion 4 includes finger indentations formed along its length to provide easy gripping by a user. Head portion 5 is offset at an angle from the longitudinal axis of grip portion 4 in order to permit easy access for cleaning all surfaces of a toilet bowl. A collar 8 located between grip portion 4 and head portion 5 aids in preventing water from dripping or contacting a user's hand during use.

As shown best in FIGS. 1 and 2, head portion 5 includes a pair of flat wings 8, 9 projecting from opposite sides thereof. Tongue member 6 is U-shaped having a pair of legs 10, 11 and a web 12. Legs 10, 11 are pivotally connected to wings 8, 9 respectively, by means of living hinges 13, 14. Hinges 13, 14 permit tongue member 6 to pivot between a first attached position for attaching the toilet bowl cleaning pad 2 to handle member 3, as best shown in FIGS. 1–5, and a second detached position, as best shown in FIG. 7, wherein tongue member 6 is spaced from head portion 5 for releasing pad 2 from handle member 3. Legs 10, 11 define inside edges 15, 16 respectively which are substantially parallel to the outside edges 17, 18 of head portion 5. Additionally, web 12 defines a leading edge 19 and a trailing edge 20 with trailing edge 20 disposed parallel to and spaced forwardly of leading edge 21 of head portion 5. As seen best in FIG. 2, the width of tongue 6 substantially conforms to the width of pad 2, and opposite ends of leading edge 19 of web 12 are rounded to permit easy insertion into pad 2, as will hereinafter be described.

Lock mechanism 7 comprises a snap lock disposed along and cooperating between leading edge 21 of head portion 5 and trailing edge 20 of web 12. More specifically, lock mechanism 7 includes a pair of spaced apart resilient fingers 22, 23 projecting rearwardly from trailing edge 20. The outer end of each finger 22, 23 overlaps an edge margin 24 which defines an abutment surface adjacent leading edge 21 of head portion 5 so that tongue member 6 is securely attachable to head portion 5.

The locking mechanism 7 also includes fastening means for fastening the toilet bowl cleaning pad 2 to tongue member 6 when tongue member 6 is in its attached position. This fastening means includes a tab member 25 disposed between fingers 22, 23 and projecting rearwardly from trailing edge 20 of web 12. The upper surface of tab 25 defines a clamping surface 26 which is engageable with leading edge 21 of head portion 25 when tongue member 6 is in its attached position. As shown best in FIG. 2, leading edge 21 also includes a tab receiving recess 27 formed therein and aligned with tab 25. Recess 27 allows a portion of pad 2 to be trapped between clamping surface 26 and recess 27 when tongue member 6 is in its attached position to securely hold pad 2 in place.

Toilet bowl cleaning pad 2 includes a thin biodegradable, non-woven, laminate 28 composed of rayon or paper which contains a cleaning composition generally designated by the numeral 29. Laminate 28 has a weight of about 14 to 25 grams per square inch, and completely encloses cleaning composition 29. Laminate 28 and cleaning composition 29 are also surrounded by and contained within an outer pouch 30 which is also made of a pair of non-woven, biodegradable rayon material members that are heat sealed along their periphery to form pouch 30. Pouch 30 has a weight of about 40 to 70 grams per square inch and defines a cleaning surface 31 and an attachment surface 32. Pouch 30 is heat sealed around its outer edge margin so as to completely contain laminate 28 and cleaning composition 29. Pouch 30 also includes a pocket 33 defined by a flap 34 disposed on attachment surface 32. Pocket 33 is dimensioned to slidably receive tongue member 6 so that flap 34 may be clamped to head portion 5 via lock mechanism 7, as best shown in FIGS. 2–5. The opposite surface or cleaning surface 31 includes a plurality of openings 35 therein to permit cleaning composition 29 to permeate therethrough as soon as composition 29 dissolves upon contact with water contained within a toilet bowl. Openings 35 also function to direct the cleaning composition 29 toward the surfaces of a toilet bowl. Surface 31 is also coated with an adhesive material to provide a textured pattern 36 to aid in scrubbing and cleaning the surfaces of a toilet bowl and further provide the heat seal for pouch 30 and laminate 28. The adhesive may be a hot melt adhesive with a melting point of about 185° F. so as to provide adequate adhesion to surface 31. Typical examples of hot melt adhesives suitable for use herein include polyamide resins, polyester resins and acrylic resins.

Cleaning composition 29 contains an acid, an alkali carbonate and one or more surfactants. The acid and alkali carbonate react in an acid/base reaction with water in the toilet bowl to release carbon dioxide gas. This carbon dioxide gas acts with the surfactants and the grinding action of the abrasive coating and textured pattern on cleaning surface 31 of pad 2 to clean and sanitize a toilet bowl.

The acidic constituent is present in the range of from about 5 to about 80% by weight, and preferably between 25 to 75% by weight. Suitable acids for use in the composition of the present invention include citric acid, sodium bisulfate, oxalic acid, malonic acid, succinic acid, glutaric acid, adipic acid, suberic acid, maleic acid, fumaric acid, sodium citrate, sodium sulfite, potassium citrate, and mixtures thereof. The preferred acids are citric acid in the range of 5 to 40% by weight and sodium bisulfate in the range of 40 to 80% by weight. Thus, the acidic constituent of composition 29 contains one or more acids having the formula:

$$HOOC—(CH_2)_n—COOH$$

where n is 2, 3, or 4.

The alkali carbonate constituent is present in the range of from about 5 to about 40% by weight, and preferably between 20 and 40% by weight. Suitable alkali carbonates for use in composition 29 of the present invention include sodium bicarbonate, sodium carbonate, calcined sodium carbonate, sodium sesquicarbonate, potassium bicarbonate and potassium carbonate. The preferred alkali carbonate is sodium bicarbonate in the range of 5 to 40% and/or sodium carbonate in the range of 5 to 40% by weight.

Surfactants that may be employed are anionic, nonionic, and amphoteric agents either alone or in various combinations. The surfactant constituent is present in the range of from about 0.5 to about 20% by weight in composition 29 of the present invention, and is preferably present in the range of 0.5 to 8% by weight. Suitable surfactants that may be employed are nonoxynol-9, linear alkyl naphthalene sulfonate, ethoxylated alcohol, alkyl ether sulfates, linear alkyl naphthalene, alcohol ethoxysulfates, alkyl benzene sulfonate, alpha olefin sulfonate, linear alcohol ether sulfates, alkyl sulfates, taurates, sarcosinates, isethionates, cyclorimides, linear alkylbenzene sulfonates, and mixtures thereof. The preferred surfactant is ethoxylated alcohol which is available under the trade designation Alfonic 810-60 and Alfonic 1412-60 from Vista Chemical Company. Other preferred surfactants, which are anionic, are linear alkyl naphthalene sulfonate which is available under the trade designation Petro 22 from the Petrochemicals Company, Inc., and linear primary alcohol ethoxylate which is available under the trade designation Neodol 45-13 from the Shell Chemical Company. All of the above surfactants are available in dry form and have very good detergency, wetting, foaming and emulsifying properties. Because these surfactants are available in dried powder form, they have relatively large surface areas and may be easily reacted in the acid base reaction with water to form an effervescing foam. Each of the above surfactants also are relatively non-toxic and readily biodegradable. The above surfactants may be used alone or in combination.

Other ingredients may be added to composition 29 to provide other valuable features. For example, halogen containing compounds, preferably chlorine containing compounds, and quaternary ammonium compounds may be employed in the surfactant-alkali-acid blend to provide better germicidal properties than the blend alone. Suitable compounds include quaternary ammonium compounds as well as halogenated compounds such as sodium dichloroisocyanurate dihydrate, alkali metal or alkaline earth metal hypochlorites, hypochlorite addition products, chloramines, chlorimines, chloramides, chlorimides, heterocyclic N-Bromo and N-Chloro cyanurates, halogenated hydantoins, halogenated melamines, and inorganic hypohalite releasing agents. The bactericidal agents reduce odor causing bacteria and are preferably present in composition 29 within a range of from about 0.1% to about 1% by weight. A particularly preferred bactericidal agent is sodium dichloro isocyanurate dihydrate which is available under the trade designation CDB Clearon available from FMC Corporation.

Composition 29 may also include from about 1 to about 20% by weight of a filler. Suitable fillers includes sodium chloride, sodium sulfate, calcium carbonate, diatomaceous earth, and mixtures thereof. Two particularly preferred fillers are sodium chloride and sodium sulfate.

Composition 29 may also include a bleaching agent within a range from about 5 to about 40% by weight depending upon its compatibility with the particular bactericidal agent utilized. Suitable bleaching agents include sodium percarbonate, sodium perborate, sodium persulfate, potassium persulfate, and mixtures thereof. The preferred bleaching agent is sodium percarbonate.

Other ingredients that may be added to the surfactant-alkali-acid composition 29 include color and/or fragrances. Examples of these are FD & C Blue No. 1, FD & C Yellow No. 5 and FD & C Red No. 40. The preferred color is FD & C Blue No. 1 which is a water soluable blue dye that provides an attractive clear blue color to the water in the toilet bowl upon dissolving of composition 29. The coloring is generally present in an amount of about 0.02% by weight.

Fragrances that may be used are any suitable acid/-base stabilized fragrance associated with the desirable end results. Examples of fragrances could be lemon, citrus or pine. The fragrance is present in the amount of about 1.0% by weight and is preferably in an encapsulated form which is a stable, easily blended fresh scent that leaves the toilet bowl with a pleasant smell after treatment with composition 29.

Composition 29 is preferably a powder packaged in a laminate 28 which is a biodegradable disposable rayon or paper material. Laminate 28 in turn would be wrapped and surrounded by pouch 30 to prevent additional moisture damage. Pouch 30 is also composed of a biodegradable disposable rayon and the entire pouch 30 containing composition 29 would be removed from a package or dispenser by a user and tongue 6 would be slid into pocket 33 whereupon downward pressure on handle 3 would lock flap 34 and tongue 6 to head portion 5 of handle 3. A user would then insert pad 2 into the water in a toilet bowl to dissolve composition 29 whereupon an effervescing foaming action occurs. Thereafter, the consumer scrubs the surfaces of the toilet bowl to clean and sanitize the toilet bowl.

FIG. 8 illustrates an alternate form of the toilet bowl cleaning pad or packet, generally designated in this embodiment as the numeral 40. In this embodiment, pad 40 includes a heat sealed pouch 41 composed of a biodegradable disposable non-woven rayon material, and is also similar in all other respects to pouch 30 of the first embodiment, including having an adhesive material formed textured pattern 42 on a cleaning surface 43. However, in this embodiment pouch 41 directly contains and surrounds the cleaning composition without an inner laminate. Additionally, pouch 41 contains only three openings 44 in its cleaning surface 43 for directing the cleaning composition against the toilet bowl surface during use. As shown, openings 44 are initially covered by a pressure sensitive peel-off label 45 which is removed just prior to use of pad 40.

In order to remove pad 2 from handle 3, the user merely flips handle 3 upsidedown or 180° from that shown in FIG. 1 and applies downward pressure on tongue 6 until tongue 6 is released from head portion 5. Tongue 6 and pad 2 then pivot away from head portion 5 (FIG. 7) allowing pad 2 to slide off of tongue 6 into the toilet bowl where it may be flushed along with the water used for the cleaning operation.

A particularly advantageous blend or mixture for cleaning composition 29 comprises about 22% by weight sodium carbonate, about 75% by weight sodium bisulfate, and about 3% by weight ethoxylated alcohol. Another particularly advantageous blend or mixture for composition 29 includes about 32% by weight sodium bicarbonate, about 32% by weight citric acid, about 32% by weight sodium percarbonate, and about 3% by weight linear alkyl naphthalene sulfonate (Petro 22).

Composition 29 is further described in the following examples which include two main formulas listing several variations of each formula.

EXAMPLE I

| | #1 | #2 | #3* | #4 | #5 |
|---|---|---|---|---|---|
| Sodium bisulfate (5) | 62.00 | 50.0 | 75.0 | 62.0 | 79.5 |
| Sodium bicarbonate | | | | 14.5 | 15.5 |
| Sodium carbonate | 20.0 | 40.0 | 22.2 | 22.0 | |
| Sodium Chloride | 15.3 | 8.6 | | | |
| Alfonic 810-60/Alfonic 1412-60 | 2.5 | 1.2 | 2.6 | 0.5 | |
| Petro 22 | | | | | 4.0 |
| Silica | | | 0.8 | 0.8 | |
| Fragrance | 0.1 | 0.1 | 0.1 | 0.1 | 0.1 |
| FD&C Blue #1 | 0.1 | 0.1 | 0.1 | 0.1 | 0.1 |
| | 100% | 100% | 100% | 100% | 100% |

*Preferred formula

EXAMPLE II

| | #6 | #7 | #8* |
|---|---|---|---|
| Sodium bicarbonate (%) | 25.0 | 28.0 | 32.0 |
| Citric acid | 25.0 | 28.0 | 32.0 |
| Sodium percarbonate | 25.0 | 35.0 | 32.0 |
| Pertro 22 | 3.0 | 8.8 | 3.0 |
| Sodium sulfate | 21.0 | | |
| Silica | 0.8 | | 0.8 |
| Fragrance | 0.1 | 0.1 | 0.1 |
| FD&C Blue #1 | 0.1 | 0.1 | 0.1 |
| | 100% | 100% | 100% |

*Preferred formula

The present invention thus provides a composition for cleaning and sanitizing a toilet bowl as well as a holder for a disposable toilet bowl cleaning pad which contains the composition. The composition includes one or more surfactants, an alkali carbonate and an acid. Germicidal ingredients, fillers, fragrances and/or colors may also be added to the blend as desired.

Various modes of carrying out the invention are contemplated as being within the scope of the following claims particularly pointing out and distinctly claiming the subject matter which is regarded as the invention.

I claim:

1. A holder for a disposable toilet bowl cleaning pad, comprising:

an elongate rigid handle member having a grip portion at one end and a head portion at its opposite end, said head portion includes a leading edge;

a tongue member having opposite ends with one of said ends pivotally mounted on said head portion and the other of said ends movable between a first attached position for attaching a disposable toilet bowl cleaning pad having a premeasured amount of a cleaning composition therein to said handle member and a second detached position for releasing said pad from said handle member, said tongue member includes a trailing edge spaced forwardly of said head portion leading edge; and lock means for releasably locking said tongue member to said head portion of said handle member, said lock means comprises a snap-lock mechanism located along said leading and trailing edges which includes a resilient lock means on one of said edges releasably engageable with an abutment surface on the other of said edges.

2. The holder of claim 1 wherein said resilient lock means includes a pair of spaced apart resilient fingers projecting rearwardly from said trailing edge, and said head portion includes an edge margin portion adjacent said leading edge defining said abutment surface.

3. The holder of claim 2 wherein said tongue member is U-shaped.

4. The holder of claim 2 further including fastening means for fastening a toilet bowl cleaning pad to said tongue member when said tongue member is in its attached position.

5. The holder of claim 4 wherein said fastening means comprises a tab member projecting rearwardly from said trailing edge that defines a clamping surface engageable with said leading edge when said tongue member is in its attached position.

6. The holder of claim 5 wherein said fastening means further includes a tab-receiving recess formed in said leading edge and aligned with said tab whereby at least a portion of said toilet bowl cleaning pad is trapped between said clamping surface and said recess when said tongue member is in its attached position.

* * * * *